US009149074B2

(12) United States Patent
Dougherty

(10) Patent No.: US 9,149,074 B2
(45) Date of Patent: Oct. 6, 2015

(54) CHILD GARMENT WITH INTEGRATED SAFETY FEATURES

(71) Applicant: Kevin Dougherty, New York, NY (US)

(72) Inventor: Kevin Dougherty, New York, NY (US)

( * ) Notice: Subject to any disclaimer, the term of this patent is extended or adjusted under 35 U.S.C. 154(b) by 75 days.

(21) Appl. No.: 14/153,541

(22) Filed: Jan. 13, 2014

(65) Prior Publication Data

US 2015/0196063 A1 Jul. 16, 2015

(51) Int. Cl.

| | |
|---|---|
| ***A62B 35/00*** | (2006.01) |
| ***A41D 11/00*** | (2006.01) |
| ***A41B 13/08*** | (2006.01) |
| ***A41D 13/00*** | (2006.01) |
| *A41D 27/02* | (2006.01) |

(52) U.S. Cl.

CPC ..... *A41B 13/08* (2013.01); *A41D 11/00* (2013.01); *A41D 13/0007* (2013.01); *A41D 27/02* (2013.01)

(58) Field of Classification Search

CPC ..... A41D 13/0007; A41D 11/00; A41D 2400/482; A41D 13/1254; A41D 27/00; A41D 27/02; A41D 13/00; A41D 13/02; A41D 13/1245; A41D 2400/48; A41B 13/10; A41B 13/005; A47D 13/025; A47D 13/086; A47D 15/006; A47D 13/04; A47D 13/063; A61G 1/044; A61G 7/075; A61G 7/0755; A61G 7/1051; A61G 7/10; A62B 35/0025; A62B 35/0006; A62B 1/02; A62B 35/00; A62B 35/0012; A62B 35/0018; A62B 35/04; A63B 2208/12; A63B 21/0552

See application file for complete search history.

(56) References Cited

U.S. PATENT DOCUMENTS

| | | | | | |
|---|---|---|---|---|---|
| 602,861 | A | * | 4/1898 | Lyon | 119/770 |
| 1,050,934 | A | * | 1/1913 | Fanta | 2/113 |
| 1,473,789 | A | * | 11/1923 | Killfeather | 2/75 |
| 1,651,561 | A | * | 12/1927 | Storey | 119/770 |
| 2,568,304 | A | * | 9/1951 | Schoenbrun | 119/770 |
| 2,623,678 | A | * | 12/1952 | Law | 297/465 |
| 3,997,921 | A | * | 12/1976 | Knight | 2/75 |
| 4,449,253 | A | * | 5/1984 | Hettinger | 2/93 |
| 4,599,750 | A | * | 7/1986 | Rahaman | 2/243.1 |
| 4,639,946 | A | * | 2/1987 | Koenig | 297/465 |
| 4,850,376 | A | | 7/1989 | DellaVecchia et al. | |
| 4,981,307 | A | * | 1/1991 | Walsh | 280/290 |
| 5,083,797 | A | * | 1/1992 | Vartija et al. | 473/424 |
| 5,183,059 | A | | 2/1993 | Leonardi | |
| 5,259,338 | A | * | 11/1993 | Cornell | 119/770 |
| 5,369,804 | A | * | 12/1994 | Metcalf | 2/69 |
| 5,542,123 | A | * | 8/1996 | DiPietro | 2/80 |
| 6,167,572 | B1 | * | 1/2001 | Naumovitz | 2/227 |
| 6,204,207 | B1 | * | 3/2001 | Cederblad et al. | 442/5 |
| 6,230,329 | B1 | * | 5/2001 | Jennings | 2/114 |
| 6,334,221 | B1 | * | 1/2002 | Hope | 2/69.5 |
| 6,378,465 | B1 | * | 4/2002 | Austin | 119/770 |
| 6,489,000 | B1 | * | 12/2002 | Ogura et al. | 428/45 |
| 6,836,902 | B2 | * | 1/2005 | Marquez et al. | 2/69 |
| 6,893,308 | B1 | * | 5/2005 | Hayles | 441/83 |
| 7,008,154 | B1 | * | 3/2006 | Nolle | 410/118 |
| 7,225,472 | B2 | * | 6/2007 | McDonald et al. | 2/102 |

(Continued)

*Primary Examiner* — Bobby Muromoto, Jr.

(74) *Attorney, Agent, or Firm* — Keaty Law Firm, LLC

(57) ABSTRACT

An infant garment with integrated safety features. The garment is formed as a multi-layered article of clothing, where a net-like harness is sandwiched between two fabric layers. The harness covers substantially entire torso of the infant. The harness has a handle extending through an opening of the outer layer. When a caregiver lifts the child using the handle of the harness, the lifting force is distributed about the torso of the infant without concentrating the lifting force in one small area.

16 Claims, 4 Drawing Sheets

(56) References Cited

U.S. PATENT DOCUMENTS

| | | | | |
|---|---|---|---|---|
| 7,574,750 | B2 * | 8/2009 | Harris | 2/80 |
| 7,707,660 | B2 * | 5/2010 | Grilliot et al. | 2/455 |
| 7,818,818 | B2 * | 10/2010 | Grilliot et al. | 2/94 |
| 8,403,189 | B2 * | 3/2013 | Nyberg et al. | 224/160 |
| 8,430,204 | B1 * | 4/2013 | Reynolds | 182/3 |
| 8,522,364 | B2 * | 9/2013 | O'Brien | 2/227 |
| 8,656,516 | B1 * | 2/2014 | Reinhardt Rawlings et al. | 2/80 |
| 8,863,313 | B2 * | 10/2014 | Grilliot et al. | 2/81 |
| 8,905,803 | B2 * | 12/2014 | Hobbs et al. | 441/80 |
| 2003/0016996 | A1 * | 1/2003 | Gelfand et al. | 404/6 |
| 2003/0201653 | A1 * | 10/2003 | Baker et al. | 294/74 |
| 2003/0224914 | A1 * | 12/2003 | De Montesquieux | 482/148 |
| 2004/0045073 | A1 * | 3/2004 | Marquez et al. | 2/69 |
| 2004/0056056 | A1 * | 3/2004 | Fabricius | 224/262 |
| 2005/0138717 | A1 * | 6/2005 | Le Gal | 2/102 |
| 2006/0226038 | A1 * | 10/2006 | Lampley | 206/315.9 |
| 2006/0253983 | A1 * | 11/2006 | Falabrino | 5/618 |
| 2006/0279115 | A1 * | 12/2006 | Tisdelle | 297/216.12 |
| 2007/0062995 | A1 * | 3/2007 | Kasuli et al. | 224/637 |
| 2007/0151624 | A1 * | 7/2007 | Munz | 141/86 |
| 2007/0241146 | A1 * | 10/2007 | Nyberg et al. | 224/160 |
| 2007/0277321 | A1 * | 12/2007 | Leach | 5/655 |
| 2008/0157580 | A1 * | 7/2008 | Lin | 297/391 |
| 2008/0201830 | A1 * | 8/2008 | Ishida et al. | 2/467 |
| 2008/0223203 | A1 * | 9/2008 | Ravid et al. | 89/36.02 |
| 2009/0144876 | A1 * | 6/2009 | Pena et al. | 2/102 |
| 2011/0104979 | A1 * | 5/2011 | Monaghan | 446/227 |
| 2012/0012421 | A1 * | 1/2012 | Morgan et al. | 182/3 |
| 2013/0305454 | A1 * | 11/2013 | Ben-Galim | 5/628 |

* cited by examiner

CHILD GARMENT WITH INTEGRATED SAFETY FEATURES

BACKGROUND OF THE INVENTION

This invention relates to an infant garment wearable by an infant with safety features that can be used to restrain movements of the infant or used as a lifting device.

As the infants grow, they develop a set of functional skills or age-specific tasks. Crawling and walking are some of the developmental milestones that most children accomplished between the ages of seven and twelve months. When crawling or walking, the infants often fall and may incur serious injuries hitting themselves on the corners of hard objects, such as furniture, kitchen cabinetry, etc. Therefore, the parents and caregivers are strongly encouraged to watch the child as he becomes more mobile. In case of an emergency, the caregiver can lift the child and move him to a more safe area.

However, in an emergency situation, when every second counts, it is not always expeditious or practical to lift the child by grasping him under the arms in a conventional manner. Often time, the emergency personnel are forced to hold one object with one hand and lift the infant with another. A baby can weigh more than twenty pounds by the age of 12 months. Therefore, simply pulling the child by his arm may dislocate the child's shoulder and cause serious damage.

The industry has developed different harnesses that are secured on the child's body over the child's clothing. Some such harnesses are designed as safety tethers that lets the caregiver keep the child close by when walking. Such devices are usually strapped around the child's torso; the harnesses are provided with a tether that the parent holds in her hand as the child is trying to walk. Another known device is a walking assistant that can be used when the child is just learning to walk. It is formed as a vest that fastens around baby's chest and has upwardly extending straps so that parents can hold the straps while the baby tries to walk. The parents can remain in an upright position since the straps are long enough to extend to about the parent's waist.

While these devices may be beneficial under certain conditions, none of them allows the parent or emergency personnel to quickly lift the infant such that the harness does not present any danger to the baby's breathing. The present invention contemplates elimination of drawbacks associated with convention child harnesses and provision of a child-wearable garment with integrated harness that distributes the lifting load around the child's torso in a safe and effective manner.

SUMMARY OF THE INVENTION

It is, therefore, an object of the present invention to provide an infant garment with integrated safety harness.

It is another object of the invention to provide a child-wearable garment that allows a caregiver or emergency personnel to lift the child using one hand.

These and other objects of the invention are achieved through a provision of an article of clothing wearable by an infant. The garment is configured to cover at least torso of the infant. The garment has a front portion, a back portion, opposing side portions connecting the front portion to the back portion, and an integrated harness for distributing lifting force about the torso of the infant when the lifting force is applied to the garment. The harness is formed as a net layer sandwiched between two fabric layers. A handle extending through an outer fabric layer allows a caregiver or emergency personnel to lift the infant by the handle without harming the infant.

The garment can be formed as a one-piece article of clothing that can be worn during playtime or when the child is sleeping.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
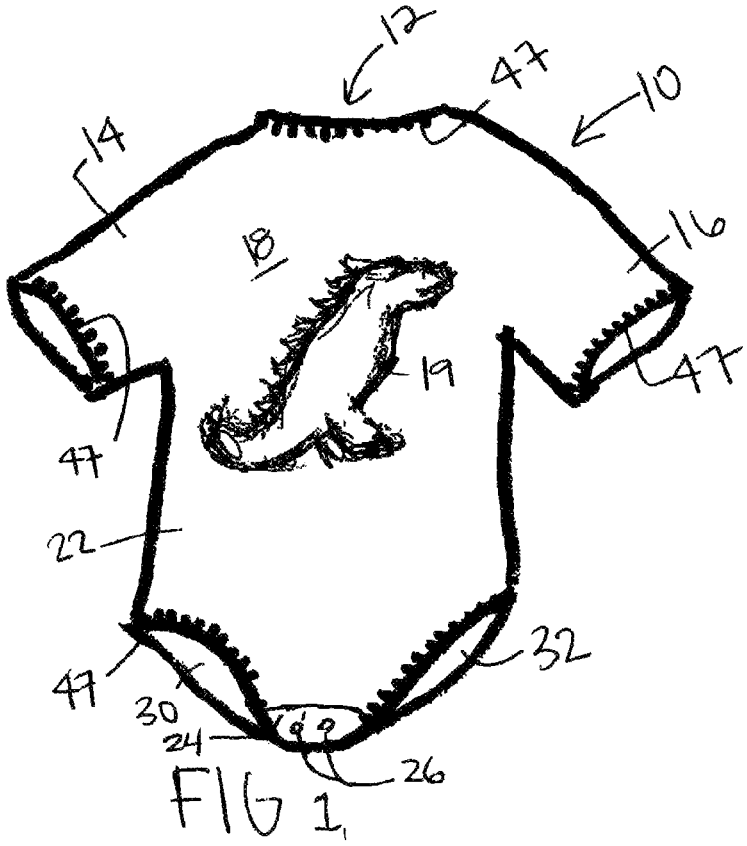
FIG. 1 is a perspective front view of the infant garment according to the present invention.
Figure 2:
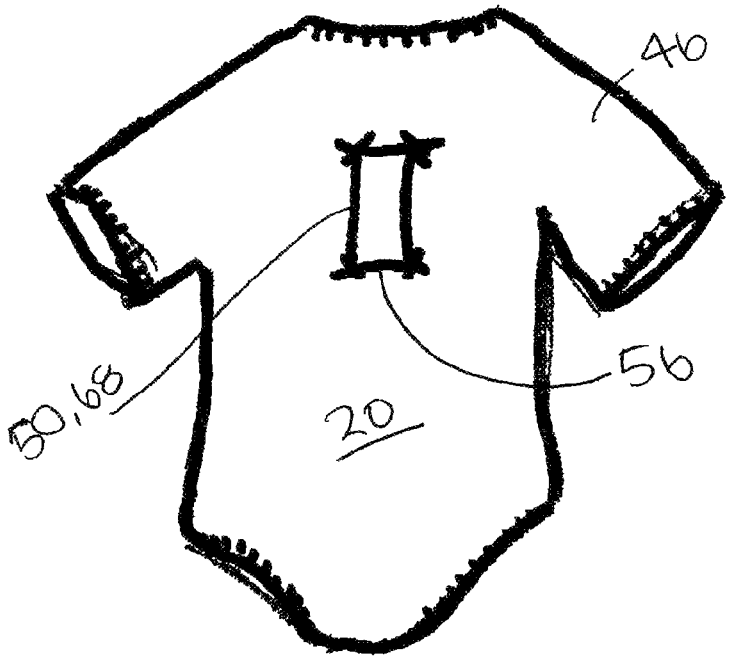
FIG. 2 is a perspective back view of the infant garment according to the present invention.
Figure 3:
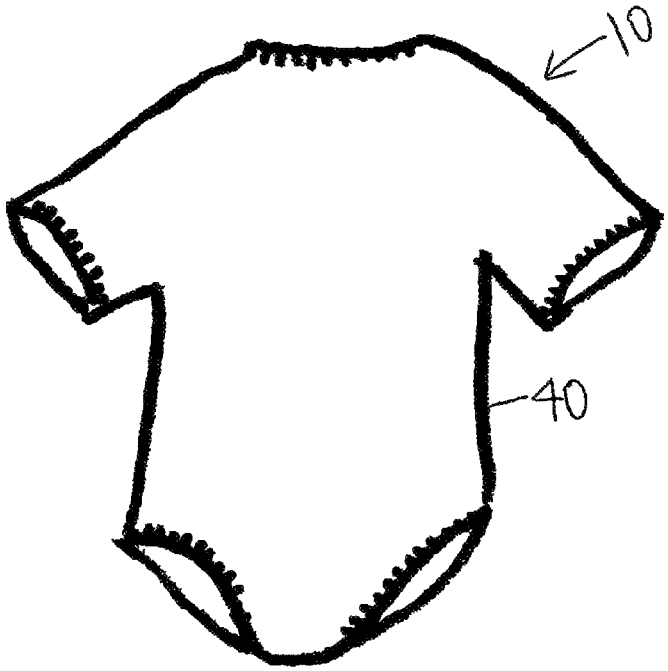
FIG. 3 is a perspective view of an inner layer of the infant garment.

Turning now to the drawings in more detail, numeral 10 designates the infant garment according to this invention. In one aspect of the invention, the garment 10 is formed as a unisex one-piece article of clothing commonly referred to as a onesie. The garment 10 is designed to cover the torso of an infant 11. The garment 10 has a neck opening 12, a pair of sleeves 14 and 16, a front portion 18, a back portion 20, and a bottom portion 22 extending to the crotch area. Side portions are continuously formed with and extend between, the front portion and the back portion. If desired, the garment may be decorated with a design 19, which can be silk-printed, appliquéd or stamped on the garment.

A bottom flap 24 extends across the crotch area from the back portion 20 to the front portion 18; one or more mating fastening elements 26, such as for instance snaps or hook-and-loop pieces, are secured to the bottom flap across the crotch area to allow a caregiver to easily change the infant's diapers. When the mating fasteners 26 are snapped together around the legs and crotch of the infant 11, a pair of openings 30, 32 for the legs is formed; the openings 30, 32 are adapted to fit snugly and comfortably about the child's legs.

Of course, the garment 10 can be formed with long sleeves sleeveless, or with leggings, if desired. Other types of clothing articles may also be used for the garment 10, such as, romper outfits, sleepers, blouses, vests, coats, jackets, etc.

The garment 10 is formed as a multi-layer unit having a first flexible inner layer 40, a second flexible middle layer 42, and a third flexible outer layer 46. The first and third layers 40 and 46 are formed from a sheet of soft fabric comprised of natural or artificial fibers or a mixture thereof. The inner layer 40 and the outer layer 46 are constructed as a one-piece article of clothing that follows the configuration of the garment 10. The inner layer 40 and the outer layer 46 are flexible, may be stretchable and somewhat resilient to fit snugly over at least the infant's torso. The inner layer and the outer layer may be also provided with sleeve portions, leg portions, collar, and other conventional elements.

The middle layer 42 is formed as a harness assembly sandwiched between the inner layer and the outer layer. The middle layer 42 comprising a grid-like net formed by a plurality of intersecting harness members configured to extend substantially over entire torso of the child 11.

Figure 4:
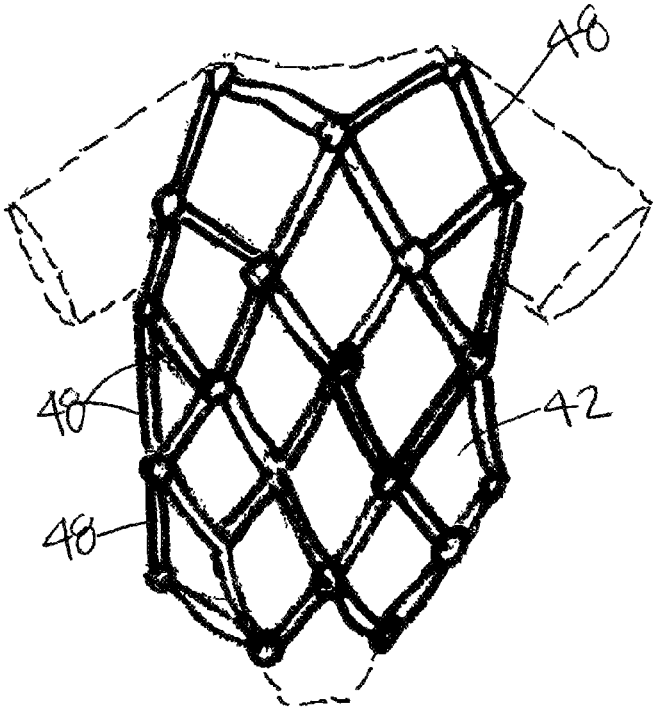
FIG. 4 is a perspective view of the middle layer of the infant garment secured to the inner layer.

The middle layer 42 is fixedly attached to the inner layer 40 by stitching or other similar mechanical means. In one aspect of the invention, the middle layer net can be stitched to the inner layer 40 only in some designated areas, for instance an upper portion, as schematically shown in the lines drawn perpendicularly to the outline of the garment in FIG. 4. The middle layer need not cover the sleeves 14, 16 of the garment 10. In one aspect of the invention, the middle layer 42 is not independently attached to the outer layer 46, but is rather covered by the outer layer 46, which serves as a shell for the harness members.

Secured to the back portion of the middle layer 42 is a handle member 50, which can be formed from a tightly woven webbing of natural or artificial fibers. The handle member 50 forms a loop with the harness members 48. The handle 50 is secured in a center location either below the shoulder blade area of the infant 11 or above the waist of the infant.

Figure 6:
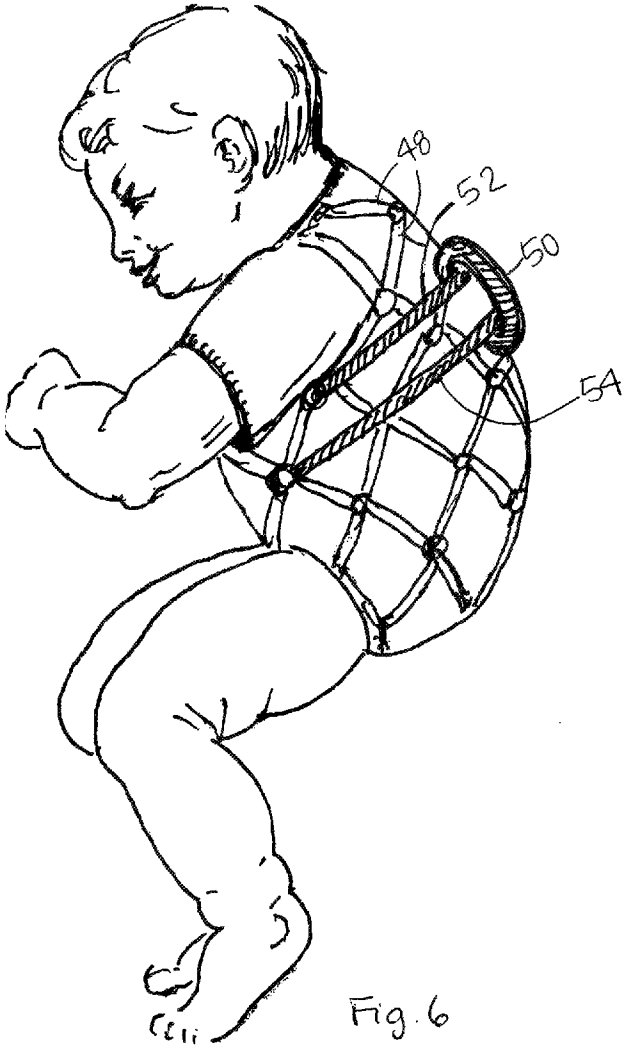
FIG. 6 illustrates the infant garment as worn by an infant, with an outer layer removed to show details of the harness structure.
Figure 5:
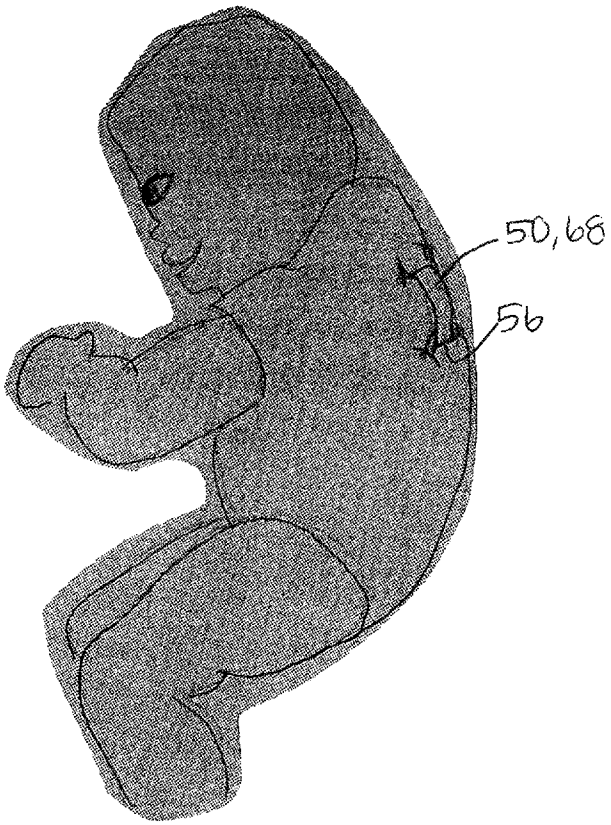
FIG. 5 is a perspective view of the infant garment as worn by an infant.

A plurality of straps is engaged with the handle member 50. In one of the embodiments, shown in FIG. 6, the invention provides for two straps: an upper strap 52 and a lower strap 54. The upper strap 52 and the lower strap 54 each comprises an elongated flexible member having opposing ends that are fixedly attached to the middle layer 42 by stitching or other suitable securing means. The upper strap 52 extends across the middle of the infant's back, side-to-side, and is sandwiched between the handle member 50 and the middle layer 42.

The lower strap 54 extends across the infant's lower back, side-to-side and has its opposite ends secured below the ends of the upper strap 52. Similarly to the upper strap 52, the lower strap 54 is sandwiched between the handle member 50 and the middle layer 42. The lower strap 52 and the upper strap 54 are positioned in a spaced-apart relationship to each other. To prevent tearing of the middle layer, the ends of the straps 52 and 54 are secured to the net at the points of intersection between the harness members 48.

An opening 56 is formed in the outer layer 46 to allow the handle 50 to extend therethrough. The edges of the opening 56 can be reinforced with zigzag stitching, pieces of non-stretchable fabric and the like. The outer layer 46 is secured to the inner layer 40 in the neck opening, sleeves openings and leg openings, as shown by cross lines 47 in FIG. 1. As a result the garment 10 presents a uniform appearance of an article of clothing, with the harness enclosed between the layers 40 and 46, and the only visible element being the handle member 50.

When the caregiver or emergency personnel need to lift the child, they grasp the handle member 50 and pull the infant wearing the garment 10 upwardly. Unlike conventional harnesses that concentrate the lifting force in small areas, the instant garment allows to fully enclose the torso of the infant and spread the lifting forces throughout the entire grid structure of the middle layer.

Figure 8:
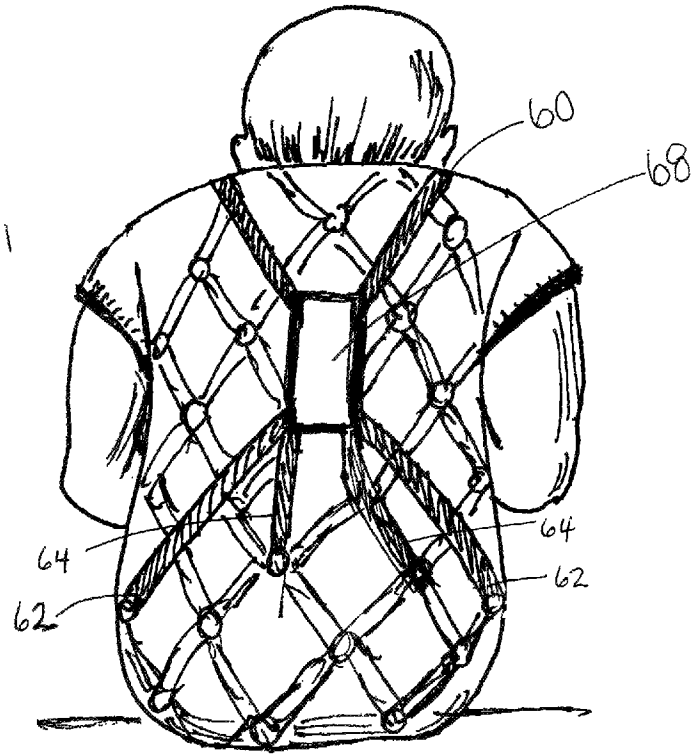
FIG. 8 illustrates an alternative strap assembly of the infant garment according to this invention.
Figure 7:
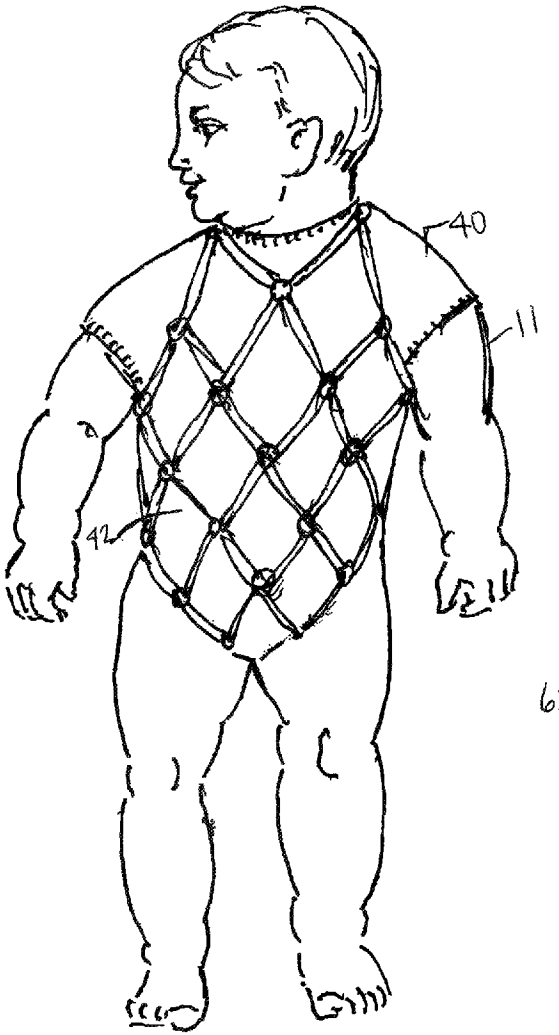
FIG. 7 illustrates the front view of the middle layer of the garment placed over the infant's torso.

Turning now to the second embodiment of the invention shown in FIG. 8, the garment 10 is shown provided with three elongated flexible straps 60, 62, and 64 engaged with the handle member 68. Similarly to the first embodiment, the handle 68 is secured to the middle layer 42 in general alignment with the center back of the infant. The first strap 60 is looped under the handle 68 and has its opposite ends secured near the shoulder area of the middle layer 42. The second strap 62 loops under the handle 68 and has its opposite ends secured to the middle layer 42 adjacent to hip area of the infant. The third strap 64 also loops under the handle member 68 and has its opposite ends secured adjacent the lower center back of the infant.

Similarly to the first embodiment, the handle member 68 extends through the opening 56 formed in the back of the outer layer 46. The user grasps the handle 68 when lifting the infant 11 and applies the lifting force. The harness members 48 and the straps 60, 62, and 64 allow the lifting force to be safely distributed throughout the grid structure and the straps 60, 62, and 64. If desired, the straps 52, 54, 60, 62, and 64 can be formed from a somewhat resilient stretchable material allowing further flexibility in the harness of the garment 10.

The garment of the instant invention can be put on the infant 11 and worn during daytime or at night time. The layers of the garment 10 can be formed from soft, flexible elements that do not cause discomfort to the infant. The garment 10 can be left on the infant 11 during playtime or during sleep. It is envisioned that the same principle of distributing the lifting force can be used when making adult clothing, particularly for incapacitated individuals who have to be evacuated in emergency situations.

Many changes and modifications can be made in the design of the present invention without departing from the spirit thereof. I, therefore, pray that my rights to the present invention be limited only by the scope of the appended claims.

I claim:

1. A garment device wearable by an infant, comprising an article of clothing configured to cover at least torso of the infant, said article of clothing having a front portion, a back portion, opposing side portions connecting the front portion to the back portion, and a means for lifting the infant integrated into the garment, said lifting means distributing lifting force about the torso of the infant when the lifting force is applied to the garment; wherein the article of clothing comprises a flexible inner layer, a flexible outer layer and a flexible middle layer sandwiched between the inner layer and the outer layer, said middle layer comprising a harness assembly made of a net that is configured to cover substantially entire torso of the infant.

2. The device of claim 1, wherein at least an upper part of the middle layer being fixedly attached to the inner layer.

3. The device of claim 1, said outer layer being fixedly attached to the inner layer independently from the middle layer.

4. The device of claim 1, the harness assembly comprising a plurality of intersecting harness members and a flexible handle member affixed to the harness members.

5. The device of claim 4, wherein an opening is formed in the outer layer of the back portion, and wherein the handle member extends through said opening outwardly from the outer layer.

6. The device of claim 4, the harness assembly comprising a plurality of elongated strap members extending between the handle member and the harness members.

7. The device of claim 6, said plurality of strap members comprising a first strap member having opposing ends secured to the harness members at side portions and a second strap member extending a distance from the first strap member and having opposing ends secured to the harness members below the first strap member.

8. The device of claim 6, said plurality of strap members comprising a first strap member having opposing ends secured to the harness members above the handle member, a second strap member having opposing ends secured to the harness members at the side portions, and a third strap member having opposing ends secured to the harness members at the back portion.

9. The device of claim 1, wherein the inner layer and the outer layer are made from a fabric.

10. A garment device wearable by an infant, comprising an article of clothing configured to cover at least torso of the infant, said article of clothing having a front portion, a back portion, opposing side portions connecting the front portion to the back portion, and a means for lifting the infant integrated into the garment, said lifting means distributing lifting force about the torso of the infant when the lifting force is applied to the garment, said lifting means comprising a harness assembly integrated into the garment and provided with a handle extending outwardly from the garment; wherein the article of clothing comprises a flexible inner layer, a flexible outer layer and a flexible middle layer sandwiched between the inner layer and the outer layer, said middle layer comprising a harness assembly made of a net that is configured to cover substantially entire torso of the infant.

11. The device of claim 10, wherein an opening is formed in the outer layer of the back portion, and wherein the handle member extends through said opening outwardly from the outer layer.

12. The device of claim 10, the harness assembly comprising a net formed by a plurality of intersecting harness members, at least a part of the harness members being affixed to the inner layer.

13. The device of claim 12, said outer layer being fixedly attached to the inner layer independently from the harness members.

14. The device of claim 10, the harness assembly comprising a plurality of elongated strap members extending between the handle member and the harness members.

15. The device of claim 14, said plurality of strap members comprising a first strap member having opposing ends secured to the harness members at side portions and a second strap member extending a distance from the first strap member and having opposing ends secured to the harness members below the first strap member.

16. The device of claim 14, said plurality of strap members comprising a first strap member having opposing ends secured to the harness members above the handle member, a second strap member having opposing ends secured to the harness members at the side portions, and a third strap member having opposing ends secured to the harness members at the back portion.

* * * * *